US008967062B1

(12) United States Patent
Gardner

(10) Patent No.: US 8,967,062 B1
(45) Date of Patent: Mar. 3, 2015

(54) SYSTEMS AND METHODS FOR CREATING QUILT BLOCKS

(71) Applicant: Action Tapes, Inc., Dallas, TX (US)

(72) Inventor: Marvin Leon Gardner, Dallas, TX (US)

(73) Assignee: Action Tapes, Inc., Dallas, TX (US)

( * ) Notice: Subject to any disclaimer, the term of this patent is extended or adjusted under 35 U.S.C. 154(b) by 0 days.

(21) Appl. No.: 14/475,402

(22) Filed: Sep. 2, 2014

Related U.S. Application Data

(63) Continuation of application No. 14/174,614, filed on Feb. 6, 2014, now Pat. No. 8,851,002.

(51) Int. Cl.
*D05B 19/12* (2006.01)
*D05B 11/00* (2006.01)
*D05C 5/02* (2006.01)

(52) U.S. Cl.
USPC ..... 112/475.19

(58) Field of Classification Search
USPC ..... 112/117, 119, 102.5, 470.01, 470.04, 112/475.01, 475.18, 475.19; 700/136–138
See application file for complete search history.

(56) References Cited

U.S. PATENT DOCUMENTS

| | | | | |
|---|---|---|---|---|
| 4,395,964 | A * | 8/1983 | Warren | 112/475.08 |
| 4,646,666 | A | 3/1987 | Burrier | |
| 4,814,218 | A | 3/1989 | Shane | |
| 6,116,978 | A | 9/2000 | Clemens | |
| 7,194,970 | B2 | 3/2007 | Srebro | |
| 7,281,337 | B1 * | 10/2007 | Oehlke et al. | 33/566 |
| 7,814,832 | B2 * | 10/2010 | Franz | 101/483 |
| 8,087,368 | B2 * | 1/2012 | Raimondo | 112/475.18 |
| 8,141,507 | B2 * | 3/2012 | Allen | 112/475.08 |
| 8,171,867 | B2 * | 5/2012 | Roche | 112/117 |
| 8,353,250 | B2 * | 1/2013 | Preston | 112/117 |
| 8,851,002 | B1 * | 10/2014 | Gardner | 112/475.19 |
| 2008/0127870 | A1 | 6/2008 | Tashiro | |
| 2010/0229773 | A1 | 9/2010 | Droese | |
| 2011/0005441 | A1 | 1/2011 | Roche | |
| 2011/0083598 | A1 | 4/2011 | Tashiro | |
| 2011/0168069 | A1 | 7/2011 | Preston | |
| 2013/0014681 | A1 * | 1/2013 | Kennedy et al. | 112/475.08 |

* cited by examiner

*Primary Examiner* — Ismael Izaguirre
(74) *Attorney, Agent, or Firm* — Kevin Alghani; Afghani PLLC

(57) ABSTRACT

Systems and methods for creating quilt blocks are provided. In one embodiment, a method for creating a quilt block with a computerized embroidery machine includes sewing placement stitching on a backing according to a placement stitching pattern provided by instructions for at least partially creating a quilt block comprised of one or more pieces, providing directions for placing one or more pieces of the quilt block on a corresponding portion of the placement stitching on the backing, and sewing the one or more pieces to the backing in accordance with the instructions.

18 Claims, 5 Drawing Sheets

SYSTEMS AND METHODS FOR CREATING QUILT BLOCKS

RELATED APPLICATIONS

This application is a continuation application of U.S. patent application Ser. No. 14/174,614 entitled "SYSTEMS AND METHODS FOR CREATING QUILT BLOCKS", filed Feb. 6, 2014, which is hereby incorporated by reference.

TECHNICAL FIELD

The illustrative embodiments relate generally to quilting, and more particularly, to systems and methods for creating quilt blocks.

BACKGROUND

In quilting, a plurality of quilt blocks are sewn together to form a quilt. Each quilt block is formed by one or more pieces of fabric. Creating quilt blocks from a plurality of pieces of fabric typically requires time in developing a plan for sewing the pieces together to form the quilt block. A degree of skill is also required in sewing pieces of fabric together to form the quilt block. Other inconveniences and problems may be encountered when sewing pieces of a quilt and/or quilt block together.

SUMMARY

According to an illustrative embodiment, a method for creating a quilt block with a computerized embroidery machine includes sewing placement stitching on a backing according to a placement stitching pattern provided by instructions for at least partially creating a quilt block comprised of one or more pieces, providing directions for placing one or more pieces of the quilt block on a corresponding portion of the placement stitching on the backing, and sewing the one or more pieces to the backing in accordance with the instructions.

According to another illustrative embodiment, a method for creating a quilt block includes securing a backing in an embroidery hoop and attaching the embroidery hoop to an embroidery machine, sewing placement stitching on the backing according to a placement stitching pattern provided by instructions for at least partially creating a quilt block comprised of one or more pieces, providing directions for placing one or more pieces of the quilt block on a corresponding portion of the placement stitching on the backing, and sewing the one or more pieces to the backing in accordance with the instructions.

DETAILED DESCRIPTION

In the following detailed description of the illustrative embodiments, reference is made to the accompanying drawings that form a part hereof. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the embodiments described herein, the description may omit certain information known to those skilled in the art. The following detailed description is, therefore, not to be taken in a limiting sense, and the scope of the illustrative embodiments are defined only by the appended claims.

Figure 1:
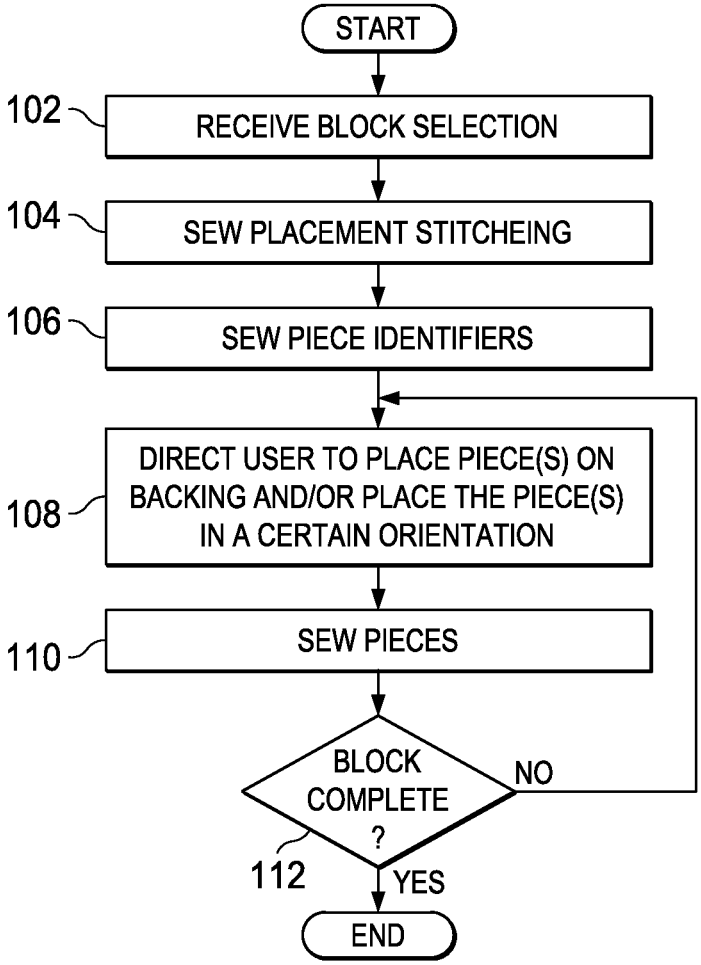
FIG. 1 is a flowchart of a method for creating a quilt block with an embroidery machine.

Referring now to FIG. 1, a method for creating a quilt block with an embroidery machine is shown. Unless otherwise indicated, as used herein, "or" does not require mutual exclusivity. In one embodiment, the method is performed by an embroidery machine, but it will be appreciated that it may be performed by any suitable device or combination of devices capable of creating a quilt block. The method begins with the embroidery machine receiving a quilt block (or block) selection from a user (step 102). In one embodiment, the block is selected from a list of predefined blocks provided to the user by the device. In one embodiment, the block may be uploaded to the device by a user such that the user may select the block. As will be discussed below, each block typically has one or more characteristics associated therewith; for example, and without limitation, the number of pieces that form the block, the fabrics or materials each piece is formed from, the dimensions of the block and/or pieces, etc. As will be further discussed below, the block may also have instructions for sewing the pieces together to form the block associated therewith including, but not limited to, how to place the pieces down, where and when to place the pieces down, the orientation a piece should be in when a particular sewing or stitching is to take place, when and where to sew stitching, or any other suitable information or instruction relevant to creating the block from one or more pieces. These instructions may be loaded to or otherwise accessed by the embroidery machine when the block is selected.

Figure 2:
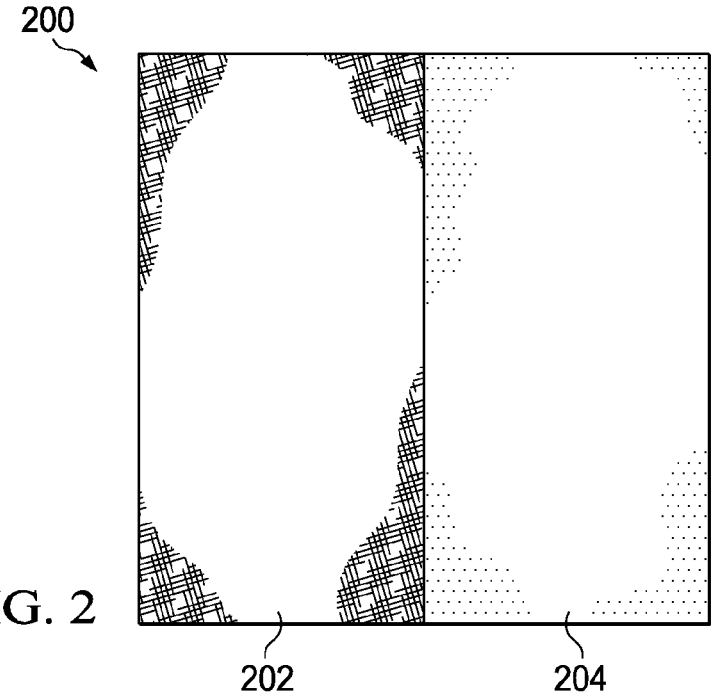
FIG. 2 shows an illustrative quilt block.

FIG. 2 shows an illustrative block 200. The block 200 comprises a first piece 202 and a second piece 204. It will be appreciated that the particular block 200 of FIG. 2 is used for illustrative purposes only and that any suitable block or block design, having any number, shape, or type of pieces, may be employed and remain within the scope of the present disclosure. This block 200 will serve as the basis for an illustration of the method throughout.

Referring again to FIG. 1, once the block selection is received (step 102), placement stitching may be sewed on a backing to which the pieces of the block will be sewed (step 104). In one embodiment, the backing is placed in an embroidery hoop attached to the embroidery machine prior to the placement stitching being sewed on the backing. The placement stitching serves to outline where the pieces of the block are to be placed on the backing. Once the placement stitching has been sewed (step 104), piece identifiers may be sewed to the backing (step 106). The piece identifiers serve to identify the location for placement of each piece of the block within a corresponding portion of the placement stitching of step 104. In one embodiment, each piece has a unique identifier and a corresponding piece identifier is sewed on the backing. For example, and without limitation, the piece identifier may be a number, letter, or any suitable symbol or character(s), marking or combination thereof. Alternatively, the different portions of the placement stitching may be identified with different colors of thread when sewing the placement stitching on the backing. Further, in one embodiment, the piece identifiers may also be associated with the order in which to lay the pieces on the backing and/or the order in which to sew the pieces on the backing.

Figure 3:
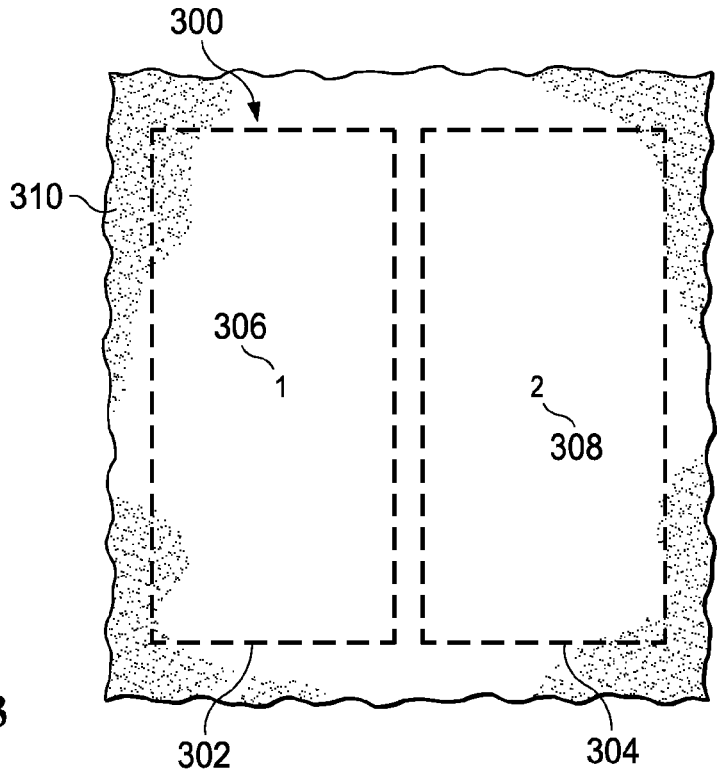
FIG. 3 shows an illustrative placement stitching pattern.

Referring now to FIG. 3, a placement stitching pattern 300 and piece identifier patterns 306, 308 for the block of FIG. 2 are illustrated on a backing 310. The placement stitching pattern 300 includes a first portion 302 identified with a first piece identifier 306 and a second portion 304 identified with a second piece identifier 308. The first portion 302 corresponds to the first piece 202 of the block 200 of FIG. 2 and the second portion 304 corresponds to the second piece 204 of the block 200 of FIG. 2.

Referring again to FIG. 1, once the placement stitching and piece identifiers have been sewed, the user is directed to place one or more pieces of the block on a corresponding portion of the placement stitching pattern associated with the piece and identified by a corresponding piece identifier on the backing (step 108). The user may be directed to place any number of the pieces forming the block on the backing including only one piece, a plurality of pieces, or all of the pieces. When to place each piece on the backing will be largely dictated by the block design and the order in which the pieces are sewed to the backing, which is, as mentioned, included in the instructions associated with the block selected at step 102. The user may also be directed to place the pieces of the block on the backing in a particular order in accordance with the instructions associated with the block selection at step 102. Further, the user may also be directed to place a piece on the backing in a particular orientation in accordance with the instructions associated with the block selected at step 102. Illustrative orientations include, but are not limited to, right side up (RSU) and right side together (RST). Next, one or more pieces of the block are sewed to the backing according to the instructions associated with the block selection (step 110). Next, it will be determined whether the block is complete (step 112). If the block is complete, the method will be finished (step 114) and the block removed from the embroidery machine. If, however, the block is not complete, the user may be prompted to take an appropriate action such as placing additional piece(s) at appropriate locations on the backing and/or orienting one or more pieces as required to form the block (step 108). Steps 108-110 may be repeated until the block is complete.

Figure 4A:
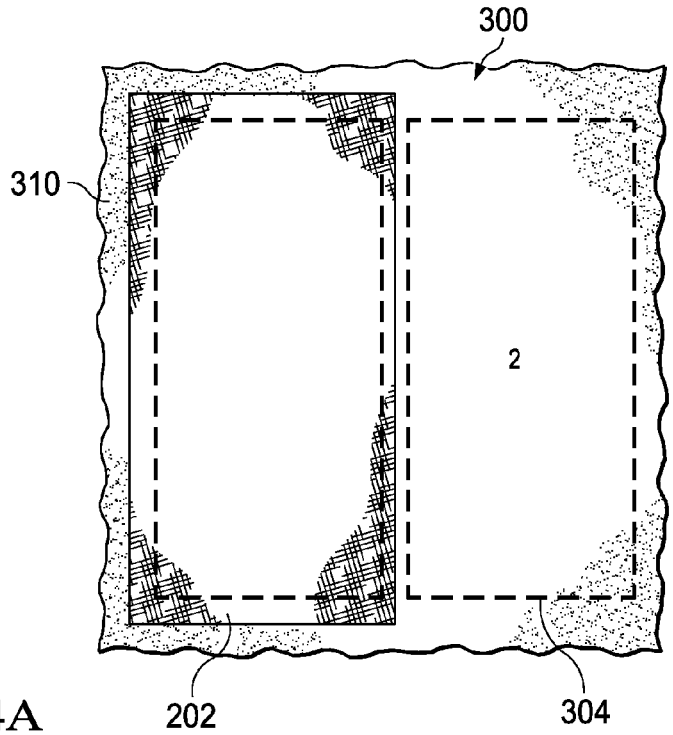
FIG. 4A-4C illustrate a sequence for creating the quilt block of FIG. 2.
Figure 4B:
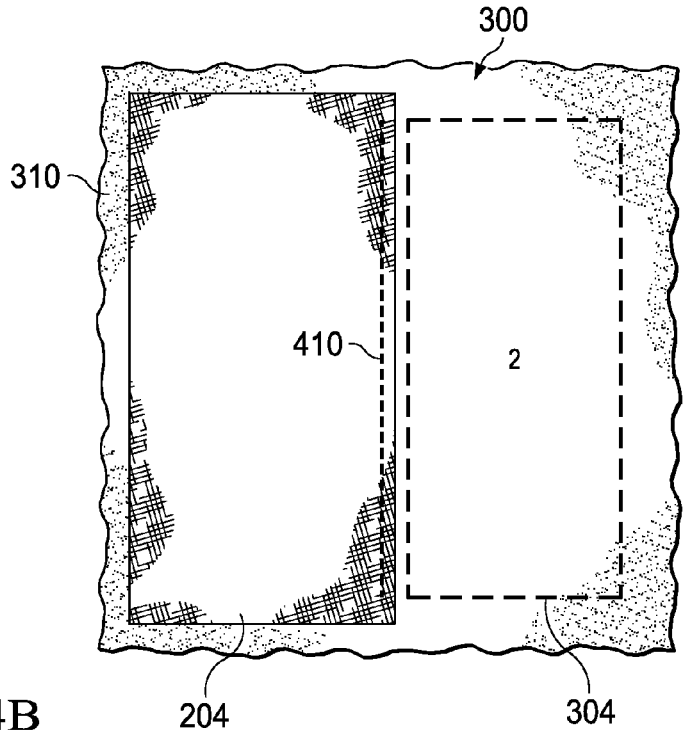
Figure 4C:
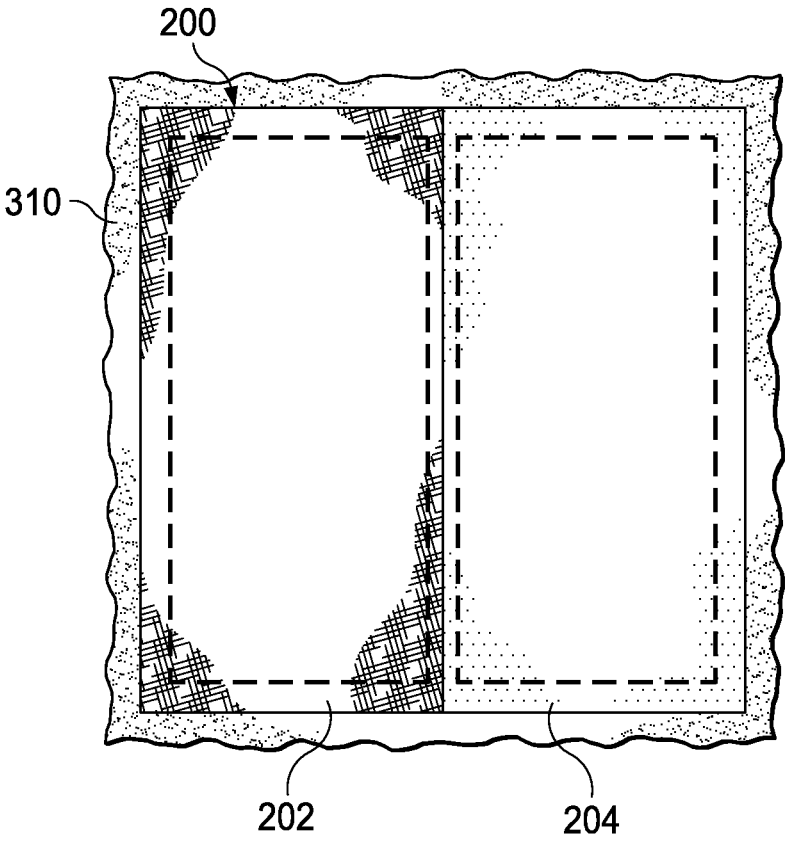

With particular reference to FIGS. 4A-4C, the sequence of steps 108-112 of FIG. 1 will be illustrated in the context of forming the illustrative block of FIG. 2. In the sequence of FIGS. 4A-4C, the placement stitching and piece identifiers of FIG. 3 have already been sewn in the backing. Also, for the sake of simplicity, the element numbers of FIGS. 2 and 3 will be employed to refer to like elements in FIGS. 4A-4C. As shown in FIG. 4A, per prompting of the user, the first piece 202 of the block is placed atop the corresponding first portion of the placement stitching pattern 200 in a RSU orientation. The first piece 202 is then sewn to the backing 310 by stitching placed about the perimeter of the first piece.

As shown in FIG. 4B, the user is then prompted to place the second piece 204 of the block atop the first piece in a RST orientation whereby the face of the first piece and the face of the second piece are adjacent to one another (i.e. with the back portion of the second piece 204 facing upwards). The embroidery machine then sews the second piece 204 to the backing 310 by way of stitching along a line illustrated with the dotted line 410.

As shown in FIG. 4C, the user is then prompted to fold the second piece 204 of the block 200 over top of the second portion of the placement stitching. The outer perimeter of the second block 204 is then sewn to the backing 310 to complete the block 200. If the backing 310 has been disposed within an embroidery hoop as previously mentioned, the backing 310 with the completed block 200 thereon may be removed from the hoop. The backing 310 may then be trimmed such that excess backing is removed from about the completed block 200.

Figure 5:
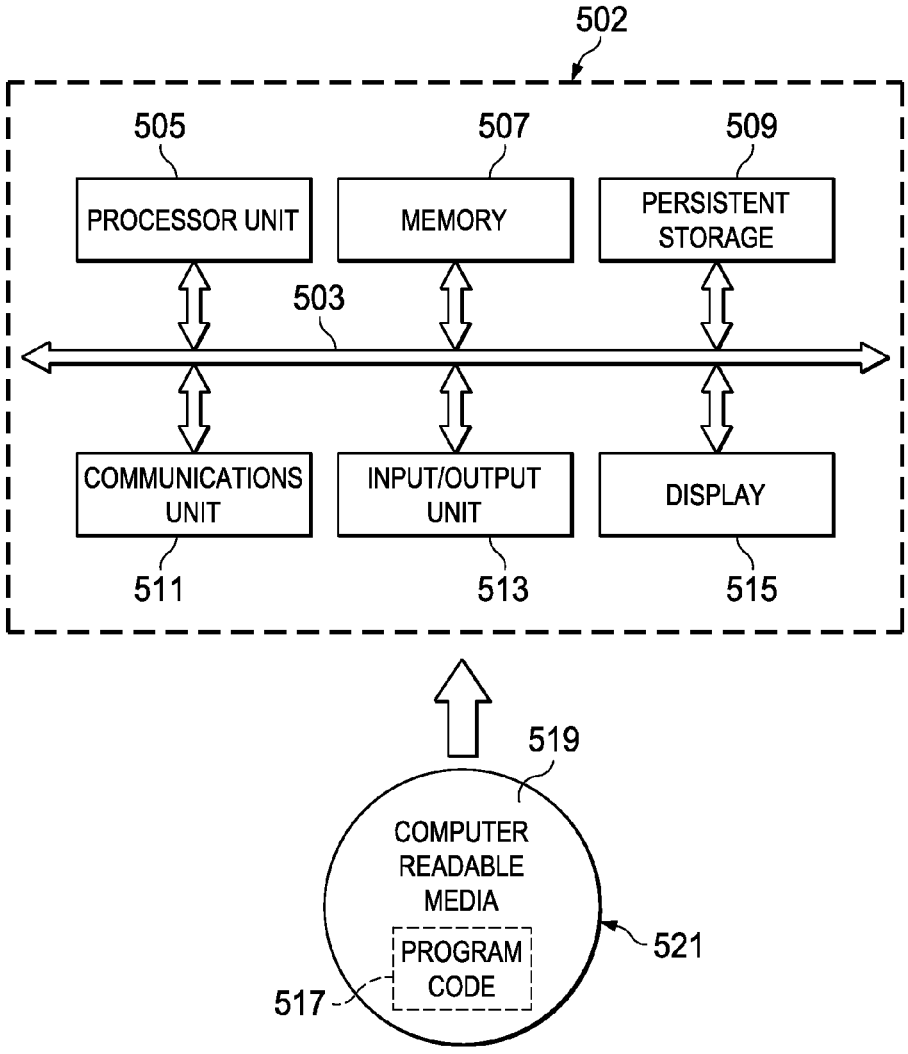
FIG. 5 is a schematic, block diagram of a data processing system in which the illustrative embodiments may be implemented.

Referring to now FIG. 5 a block diagram of a computing device 502 is shown in which the illustrative embodiments may be implemented. The computing device 502 may be a computer, an embroidery machine, a computer in communication with an embroidery machine, or any other suitable device or combination of devices. Computer-usable program code or instructions implementing the processes used in the illustrative embodiments may be located on the computing device 502. The computing device 502 includes a communications fabric 503, which provides communications between a processor unit 505, a memory 507, a persistent storage 509, a communications unit 511, an input/output (I/O) unit 513, and a display 515.

The processor unit 505 serves to execute instructions for software that may be loaded into the memory 507. The processor unit 505 may be a set of one or more processors or may be a multi-processor core, depending on the particular implementation. Further, the processor unit 505 may be implemented using one or more heterogeneous processor systems in which a main processor is present with secondary processors on a single chip. As another illustrative example, the processor unit 505 may be a symmetric multi-processor system containing multiple processors of the same type.

The memory 507, in these examples, may be, for example, a random access memory or any other suitable volatile or non-volatile storage device. The persistent storage 509 may take various forms depending on the particular implementation. For example, the persistent storage 509 may contain one or more components or devices. For example, the persistent storage 509 may be a hard drive, a flash memory, a rewritable optical disk, a rewritable magnetic tape, or some combination of the above. The media used by the persistent storage 509 also may be removable. For example, a removable hard drive may be used for the persistent storage 509.

The communications unit 511, in these examples, provides for communications with other data processing systems or communication devices. In these examples, the communications unit 511 may be a network interface card. The communications unit 511 may provide communications through the use of either or both physical and wireless communication links.

The input/output unit 513 allows for the input and output of data with other devices that may be connected to the computing device 502. For example, the input/output unit 513 may provide a connection for user input through a keyboard and mouse. Further, the input/output unit 513 may send output to a processing device. In the case in which the computing device 502 is a cellular phone, the input/output unit 513 may also allow devices to be connected to the cellular phone, such as microphones, headsets, and controllers. The display 515 provides a mechanism to display information to a user, such as a graphical user interface.

Instructions for the operating system and applications or programs are located on the persistent storage 509. These instructions may be loaded into the memory 507 for execution by the processor unit 505. The processes of the different embodiments may be performed by the processor unit 505 using computer-implemented instructions, which may be located in a memory, such as the memory 507. These instructions are referred to as program code, computer-usable program code, or computer-readable program code that may be read and executed by a processor in the processor unit 505. The program code in the different embodiments may be embodied on different physical or tangible computer-readable media, such as the memory 507 or the persistent storage 509.

Program code 517 is located in a functional form on a computer-readable media 519 and may be loaded onto or transferred to the computing device 502 for execution by the processor unit 505. The program code 517 and the computer-readable media 519 form computer program product 521 in these examples. In one embodiment, the computer program product 521 is an application or program module encompassing the method described in FIG. 1. In this embodiment, the program code 517 may include computer-usable program code capable of receiving a block selection from a user. The program code 517 may also include computer-usable program code capable of directing an embroidery machine to sew placement stitching on a backing according to a placement stitching pattern. The program code 517 may also include computer-usable program code capable of directing an embroidery machine to sew one or more piece identifiers on the backing according to a piece identifier pattern. The program code 517 may also include computer-usable program code capable of directing a user to place one or more pieces of a block on a backing. The program code 517 may also include computer-usable program code capable of directing an embroidery machine to sew one or more pieces to the backing. Any combination of the above-mentioned computer-usable program code may be implemented in the program code 517, and any functions of the illustrative embodiments may be implemented in the program code 517.

In one example, the computer-readable media 519 may be in a tangible form, such as, for example, an optical or magnetic disc that is inserted or placed into a drive or other device that is part of the persistent storage 509 for transfer onto a storage device, such as a hard drive that is part of the persistent storage 509. In a tangible form, the computer-readable media 519 also may take the form of a persistent storage, such as a hard drive or a flash memory that is connected to the computing device 502. The tangible form of the computer-readable media 519 is also referred to as computer recordable storage media.

Alternatively, the program code 517 may be transferred or deployed to the computing device 502 from the computer-readable media 519 through a communication link to the communications unit 511 or through a connection to the input/output unit 513. Such a transfer may be executed in response to a request from the user for an embroidery application. The communication link or the connection may be physical or wireless in the illustrative examples. The computer-readable media 519 also may take the form of non-tangible media, such as communication links or wireless transmissions containing the program code 517. In one embodiment, the program code 517 is delivered to the computing device 502 over the Internet.

The different components illustrated for the computing device 502 are not meant to provide architectural limitations to the manner in which different embodiments may be implemented. The different illustrative embodiments may be implemented in a data processing system including components in addition to or in place of those illustrated for computing device 502. Other components shown in FIG. 5 can be varied from the illustrative examples shown.

As one example, a storage device in the computing device 502 is any hardware apparatus that may store data. The memory 507, the persistent storage 509, and the computer-readable media 519 are examples of storage devices in a tangible form.

In another example, a bus system may be used to implement the communications fabric 503 and may be comprised of one or more buses, such as a system bus or an input/output bus. Of course, the bus system may be implemented using any suitable type of architecture that provides for a transfer of data between different components or devices attached to the bus system. Additionally, the communications unit 511 may include one or more devices used to transmit and receive data, such as a modem or a network adapter. Further, a memory may be, for example, the memory 507 or a cache such as found in an interface and memory controller hub that may be present in the communications fabric 503.

Although the illustrative embodiments described herein have been disclosed in the context of certain illustrative, non-limiting embodiments, it should be understood that various changes, substitutions, permutations, and alterations can be made without departing from the scope of the invention as defined by the appended claims. It will be appreciated that any feature that is described in a connection to any one embodiment may also be applicable to any other embodiment.

What is claimed is:

1. A method for creating a quilt block with a computerized embroidery machine, comprising:

sewing placement stitching on a backing according to a placement stitching pattern provided by instructions for at least partially creating a quilt block comprised of one or more pieces;

providing directions for placing one or more pieces of the quilt block on a corresponding portion of the placement stitching on the backing; and sewing the one or more pieces to the backing in accordance with the instructions.

2. The method of claim 1 further comprising:

receiving a quilt block selection, wherein selection of the quilt block includes the instructions.

3. The method of claim 1 further comprising:

sewing one or more piece identifiers on the backing according to a piece identifier pattern in the instructions, each piece identifier corresponding to at least one of the one or more pieces of the quilt block and identifying a particular portion of the placement stitching associated with the at least one piece.

4. The method of claim 3 wherein providing directions for placing one or more pieces of the quilt block on the corresponding portion of the placement stitching on the backing comprises providing directions for placing one or more pieces of the quilt block on the corresponding portion of the placement stitching on the backing identified by a piece identifier according to the instructions.

5. The method of claim 3 wherein the one or more pieces of the quilt block are each identified by a unique identifier.

6. The method of claim 5 wherein each of the one or more piece identifiers is a unique number corresponding to the unique identifier of a corresponding piece.

7. The method of claim 6 wherein the unique identifier is a number.

8. The method of claim 1 wherein the instructions for at least partially creating the quilt block comprise the order in which to sew the pieces.

9. The method of claim 1 wherein the instructions for at least partially creating the quilt block comprise one or more orientations in which to place each piece prior to sewing the piece to the backing.

10. The method of claim 9 wherein the one or more orientations comprises at least one of right side up or right side together.

11. A method for creating a quilt block comprising:

securing a backing in an embroidery hoop and attaching the embroidery hoop to an embroidery machine;

sewing placement stitching on the backing according to a placement stitching pattern provided by instructions for at least partially creating a quilt block comprised of one or more pieces;

providing directions for placing one or more pieces of the quilt block on a corresponding portion of the placement stitching on the backing; and sewing the one or more pieces to the backing in accordance with the instructions.

12. The method of claim 11 further comprising:

receiving a quilt block selection at the embroidery machine, wherein selection of the quilt block includes the instructions.

13. The method of claim 11 further comprising:

sewing one or more piece identifiers on the backing according to a piece identifier pattern in the instructions, each piece identifier corresponding to at least one of the one or more pieces of the quilt block and identifying a particular portion of the placement stitching associated with the at least one piece.

14. The method of claim 13 wherein providing directions for placing one or more pieces of the quilt block on the corresponding portion of the placement stitching on the backing comprises providing directions for placing one or more pieces of the quilt block on the corresponding portion of the placement stitching on the backing identified by a piece identifier according to the instructions.

15. The method of claim 13 wherein the one or more piece identifiers also identify the order in which to place the one or more pieces of the quilt block on the backing.

16. The method of claim 15 further comprising placing the one or more pieces of the quilt block on the backing in the order identified by the one or more piece identifiers.

17. The method of claim 11 further comprising sewing at least one of the one or more pieces of the quilt block to the backing when the at least one piece is in a right side up orientation.

18. The method of claim 11 further comprising sewing at least one of the one or more pieces of the quilt block to the backing when the at least one piece is in a right side together orientation.

* * * * *